United States Patent [19]

Olson, Jr.

[11] Patent Number: 4,666,481

[45] Date of Patent: May 19, 1987

[54] PROCESS FOR PRODUCING LIQUID HELIUM

[75] Inventor: Raymond R. Olson, Jr., Williamsville, N.Y.

[73] Assignee: Union Carbide Corporation, Danbury, Conn.

[21] Appl. No.: 837,216

[22] Filed: Mar. 10, 1986

[51] Int. Cl.[4] ..... F25J 3/00

[52] U.S. Cl. ..... 62/11; 62/23; 62/38; 62/42; 62/514 R

[58] Field of Search ..... 62/11, 23, 36, 38, 39, 62/42, 514 R

[56] References Cited

U.S. PATENT DOCUMENTS

| | | | |
|---|---|---|---|
| 3,260,058 | 7/1966 | Ray et al. | 62/23 |
| 3,333,435 | 8/1967 | Stewart | 62/23 |
| 3,359,744 | 12/1967 | Bolez et al. | 62/23 |
| 3,407,614 | 10/1968 | Poska | 62/18 |
| 3,599,438 | 8/1971 | Blackwell et al. | 62/22 |
| 3,609,984 | 10/1971 | Garwin | 62/22 |
| 3,691,779 | 9/1972 | Meisler et al. | 62/23 |
| 3,794,591 | 2/1974 | Collins | 62/40 |
| 3,992,167 | 11/1976 | Beddome | 62/23 |
| 4,242,885 | 1/1981 | Quack et al. | 62/514 R |
| 4,443,238 | 4/1984 | Beddome et al. | 62/39 |

*Primary Examiner*—Ronald C. Capossela
*Attorney, Agent, or Firm*—Stanley Ktorides

[57] ABSTRACT

A process for the production of liquid helium wherein refrigeration from helium-containing feed is employed to cool helium liquefier recycle and thus reduce helium liquefier power requirements.

17 Claims, 1 Drawing Figure

PROCESS FOR PRODUCING LIQUID HELIUM

TECHNICAL FIELD

This invention relates to the production of helium in the liquid form and is an improvement whereby the power requirement for such production is reduced.

BACKGROUND ART

Liquid helium, due to its inertness and to its extremely low temperature is a very valuable specialty product for such uses as a coolant for superconductivity applications, and for laboratory research.

A major cost in the production of liquid helium is the power requirement to liquefy the helium. For example, in a liquefaction process employing work expansion of recirculating helium to produce liquid helium, a major cost is the power required to compress the vapor. It is thus desirable to have a process for producing liquid helium wherein compression power requirements are reduced.

A significant amount of helium is often present in natural gas reservoirs. Accordingly, helium can be obtained as a byproduct of natural gas production, including processing of natural gases that contain nitrogen. The nitrogen may be naturally occurring and/or may have been injected into a reservoir as part of an enhanced oil recovery (EOR) or enhanced gas recovery (EGR) operation. Because of the relative volatilities of these gases, helium, which may be present with the natural gas, concentrates in the nitrogen as the nitrogen and methane are separated in a cryogenic nitrogen rejection unit (NRU). The helium may be available from the NRU at a high enough concentration to justify further concentration and recovery. When this threshold concentration is present it would be highly desirable to employ the refrigeration inherent in the nitrogen-helium stream from the NRU to reduce the power requirements for the production of liquid helium.

Accordingly it is an object of this invention to provide a process for the more efficient production of liquid helium.

It is a further object of this invention to provide a process wherein refrigeration in a helium-containing vapor is employed to reduce the power requirements for the production of liquid helium.

SUMMARY OF THE INVENTION

The above and other objects which will become apparent to one skilled in the art upon a reading of this disclosure are attained by:

A process for producing liquid helium comprising:

(a) providing a feed vapor comprising at least 20 percent helium at a temperature of 150° K. or less;

(b) cooling and partially condensing the feed to produce helium vapor and liquid remainder;

(c) warming helium vapor by indirect heat exchange with cooling feed of step (b);

(d) upgrading the helium vapor to liquefier grade helium vapor;

(e) passing liquefier grade helium vapor to a helium liquefier;

(f) partially condensing liquefier grade helium vapor in the helium liquefier to produce liquid helium and helium recycle vapor;

(g) compressing helium recycle vapor;

(h) cooling at least some compressed helium recycle vapor by indirect heat exchange with warming helium vapor of step (c); and (i) returning cooled, compressed helium recycle vapor to the helium liquefier.

As used herein, the term "indirect heat exchange" means the bringing of two fluid streams into heat exchange relation without any physical contact or intermixing of the fluids with each other.

As used herein, the term "helium liquefier" means process and apparatus for the liquefaction of a helium-containing vapor, generally but not necessarily comprising heat exchanger(s), expansion turbine(s) and phase separator(s).

As used herein, the term "liquefier grade helium" means helium having high purity with only trace amounts of impurities. Generally liquefier grade helium will have a helium concentration of 99.99 percent or more.

DETAILED DESCRIPTION

Figure 1:
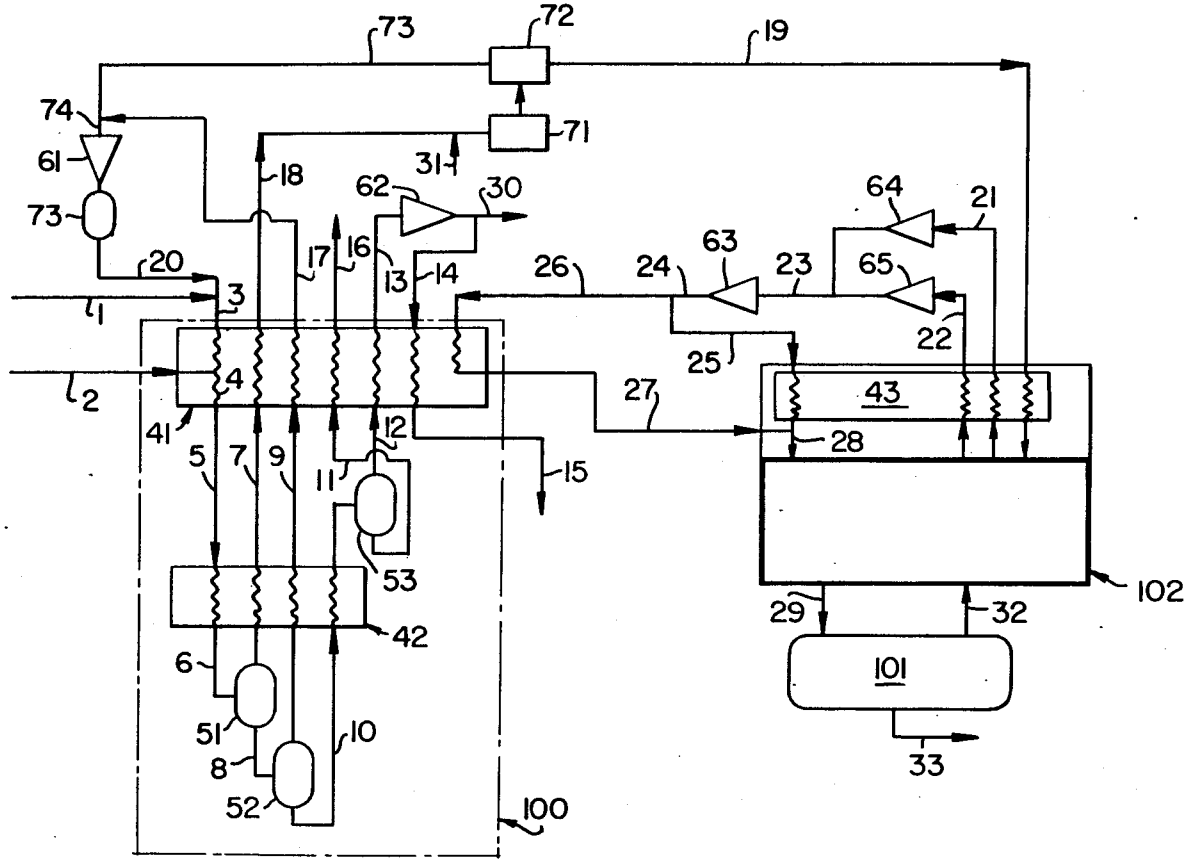
FIG. 1 is a schematic flow diagram of one preferred embodiment of the process of this invention.

The process of this invention will be described in detail with reference to FIG. 1.

Referring now to FIG. 1, feed vapor 2 comprising at least 20 percent helium and at a temperature of 150° K. or less is introduced into heat exchanger 41. Feed vapor 2 may be provided from any suitable source. One such source is from a cryogenic single or double column NRU. Recent advances in NUR technology are described and claimed in U.S. Pat. No. 4,352,685-Swallow, U.S. Pat. No. 4,415,345-Swallow, and U.S. Pat. No. 4,501,600-Pahade.

When feed vapor 2 is from an NRU it may have a helium concentration in the range of from 20 to 70 percent, and preferably the helium concentration is in the range of from 30 to 60 percent, and the balance of the stream is primarily nitrogen. Other species which may be found in feed stream 2 in small concentrations include argon, methane, hydrogen, and neon. Feed stream 2 is at a pressure in the range of from 300 to 380 psia (pounds per square inch absolute) and at a temperature in the range of from about 100° to 150° K. (degrees Kelvin). The helium-containing cold feed stream is generally available from the column section of the NRU process. For the double column NRU it can be obtained as an overhead vapor from the high pressure column. For the single column NRU process it can be obtained as the non-condensed portion from further cooling of the column overhead vapor. For both cases, the feed can be obtained as a first cut crude stream or the helium-containing stream can be partially upgraded within the NRU unit itself. Generally the vapor stream will be obtained from a phase separator and accordingly the stream temperature will correspond to saturation conditions for the stream purity and pressure conditions. However, in some instances, the feed stream can be heat exchanged within the NRU process or warmed during transfer and it will then be a superheated vapor stream. Any heat exchanging or warming of the feed is desirably minimized and the feed stream temperature will always be below 150° K. in order to transfer substantial refrigeration to the process of this invention.

FIG. 1 shows a preferred embodiment wherein a warm helium-containing vapor 1, such as from an NRU which is too distant to supply cryogenic feed and a recycle stream 20, as will be more fully described later, are combined to form combined stream 3 and this stream is combined with feed vapor 2 within heat exchanger 41 to form combined stream 4. The recycle stream or streams may be combined with the feed prior to or within heat exchanger 41.

Within heat exchanger 41 the feed is cooled and partially condensed to produce helium vapor and liquid remainder. In the preferred embodiment of FIG. 1, two-phase stream 5 from heat exchanger 41 is further cooled by passage through heat exchanger 42 and the resulting further cooled stream 6 is passed to phase separator 51 wherein it is separated into helium vapor 7 and liquid remainder 8.

The helium vapor is warmed by indirect heat exchange with the cooling feed by passage through heat exchanger 41 and the warmed helium vapor 18 is upgraded to liquefier grade helium vapor and passed to helium liquefier cold box 102. Upgrading, or the increase of the concentration of helium, may be carried out by any suitable means. When the stream 18 contains some hydrogen, the embodiment of FIG. 1 is preferred wherein stream 18 is mixed with a small amount of compressed air 31 and is passed to hydrogen removal system 71 wherein it is heated and passed over a catalyst bed where the oxidation of hydrogen to water takes place. The resulting stream is then further purified to liquefier grade helium in pressure swing adsorption (PSA) unit 72 and liquefier grade helium vapor 19 is passed to cold box 102.

The helium liquefier may comprise compressors such as compressors 63, 64 and 65, heat exchangers such as 43, phase separators such as 101 and work expansion turbines which are not shown but would be within cold box 102. In general, any process apparatus which can liquefy a helium-containing vapor stream may be employed as a helium liquefier to practice the process of this invention.

The liquefier grade helium vapor is partially condensed within the helium liquefier to produce liquid helium which is recovered, and helium recycle vapor which is compressed.

Referring now to the preferred embodiment of FIG. 1, stream 19 is cooled by passage through heat exchanger 43 and passed through a series of work expansion turbines and expansion valves to produce liquid helium 29 and helium recycle vapor 22. The liquid helium may be further expanded to produce a two phase stream which is separated in phase separator 101 into lower pressure helium vapor 32 and liquid helium 33 which is recovered. The helium vapor streams 22 and 21 are warmed by passage through heat exchanger 43 and compressed by passage through compressor 63 to form further compressed stream 24. A portion 25 of stream 24 may be directly recycled back to the helium liquefier and cooled by passage through heat exchanger 43.

At least some of the compressed helium recycle vapor is cooled by indirect heat exchange with the warming helium vapor and the resulting cooled stream is returned to the helium liquefier for partial liquefaction into product liquid helium and helium recycle vapor.

Referring again to the preferred embodiment of FIG. 1, compressed helium recycle vapor 26 is passed through heat exchanger 41 and the cooled stream 27 returned to liquefier cold box 102 wherein it is combined with stream 25 to form stream 28. This stream is then passed through the expanders to form part of liquid helium stream 29 and helium recycle stream 22. The amount of recycle vapor 26 cooled in upgrader cold box 100 will depend on the amount of cold feed vapor 2. Generally the ratio of recycle stream 26 flow to cold feed vapor 2 flow will be in the range of from about 0.8 to 1.2, and preferably will be about 1.0. Further the extent of cooling of the recycle stream 26 will depend on the temperature of cold vapor 2 stream so that typically the temperature of cooled stream 27 will be about the same as that of the cold vapor feed 2. Accordingly, the cooled recycle stream 27 temperature will be in the range of from 100° to 150° K. Generally the larger the amount of and the colder the temperature of cold vapor feed 2, the greater is the additional refrigeration which is available for transfer to helium recycle stream 26.

By recycling vapor from the helium liquefier, by cooling this recycled vapor with the refrigeration which was originally contained in cold feed vapor 2, and then by returning the cooled vapor to the helium liquefier as taught by the process of this invention, one is able to produce liquid helium with a reduction in the necessary power requirements. The reduction in necessary power will generally be about 15 percent and may be up to about 25 percent.

The embodiment of FIG. 1 is a preferred embodiment which includes additional aspects which may be employed and which will now be described.

Liquid remainder 8 from phase separator 51 is flashed to a lower pressure to produce a two phase stream which is introduced into phase separator 52. The two phase stream is separated into helium-richer vapor 9 and further remaining liquid 10. Vapor 9 is warmed by passage through heat exchanger 41 and the warmed stream 17 is reintroduced back into the feed vapor. As shown in the preferred embodiment of FIG. 1, vapor 17 is preferably combined with PSA tail gas. If the tail gas contains significant moisture, such as from a hydrogen removal step, the combined stream 74 may be compressed and dried by passage through compressor 61 and drier 73 prior to reintroduction into the feed vapor.

The further remaining liquid 10 may be further processed as shown in the preferred embodiment of FIG. 1. This further processing is particularly advantageous where the feed vapor contains significant amounts of nitrogen as this will result in the production of nitrogen vapor and/or liquid which may be advantageously employed for purging and/or cooling.

Referring to FIG. 1, liquid 10 is partially vaporized by passage through heat exchanger 42 against cooling feed. The partially vaporized stream is passed to phase separator 53 wherein it is separated into vapor 12 and waste bottoms 11. The waste bottoms 11 are heated and vaporized through heat exchanger 41 and passed out 16 of the process. Vapor 12 is warmed by passage through heat exchanger 41 and the warmed stream 13 is compressed through compressor 62 and a portion 30 may be recovered as vapor. When this recovered vapor 30 is nitrogen it may be employed as a purge gas. Another portion 14 of the compressor 62 output may be condensed by passage through heat exchanger 41 and resulting liquid 15 may be advantageously employed for example as a thermal shield to keep the product helium in a liquid state. In FIG. 1 the process arrangement which includes, heat exchangers 41 and 42 and phase separators 51, 52 and 53 may be considered all part of helium upgrader 100.

In Table I there is tabulated the results of a computer simulation of the process of this invention carried out in accord with the embodiment of FIG. 1 and with a feed vapor comprising nearly equal amounts of helium and nitrogen of about 48 percent each. Such a stream is representative of a stream taken from an NRU. The computer simulation is offered for illustrative purposes and is not intended to be limiting. In Table I the stream numbers refer to those of FIG. I, the stream flow rates are expressed as moles per 100 moles of feed, and the temperatures are in degrees Kelvin.

TABLE I

| | Stream No. | | | |
|---|---|---|---|---|
| | 1 | 2 | 3 | 13 |
| Flow/100 moles feed | 8.15 | 91.85 | 33.81 | 12.34 |
| Pressure-psia | 330 | 330 | 330 | 15 |
| Temp-deg K. | 278 | 107 | 290 | 292 |
| Conc.-mole % | | | | |
| He | 47.95% | 47.95% | 64.64% | 0.06% |
| $N_2$ | 48.12% | 48.12% | 33.89% | 97.30% |
| $CH_4$ | 0.82% | 0.82% | 0.22% | 0.10% |
| Other | 3.11% | 3.11% | 1.25% | 2.54% |
| | 14 | 15 | 16 | 17 |
| Flow/100 moles feed | 2.25 | 2.25 | 39.87 | 0.59 |
| Pressure-psia | 200 | 200 | 14.7 | 30 |
| Temp-deg K. | 294 | 86.5 | 292 | 292 |
| Conc.-mole % | | | | |
| He | 0.06% | 0.06% | 0.00% | 36.31% |
| $N_2$ | 97.30% | 97.30% | 91.36% | 62.26% |
| $CH_4$ | 0.10% | 0.10% | 2.02% | 0.05% |
| Other | 2.54% | 2.54% | 6.62% | 1.38% |
| | 18 | 19 | 20 | 24 |
| Flow/100 moles feed | 72.86 | 47.95 | 25.66 | 373.16 |
| Pressure-psia | 325 | 310 | 330 | 265 |
| Temp-deg K. | 292 | 296 | 294 | 291 |
| Conc.-mole % | | | | |
| He | 90.14% | 99.99% | 69.94% | 100.00% |
| $N_2$ | 9.41% | 0.00% | 29.37% | 0.00% |
| $CH_4$ | 0.01% | 0.00% | 0.03% | 0.00% |
| Other | 0.44% | 0.01% | 0.66% | 0.00% |
| | 25 | 26 | 27 | 31 |
| Flow/100 moles feed | 278.33 | 94.83 | 94.83 | 0.40 |
| Pressure-psia | 265 | 265 | 263 | 412 |
| Temp-deg K. | 291 | 291 | 107 | 294 |
| Conc.-mole % | | | | |
| He | 100.00%% | 100.00%% | 100.00% | 0.00% |
| $N_2$ | 0.00% | 0.00% | 0.00% | 78.00% |
| $CH_4$ | 0.00% | 0.00% | 0.00% | 0.00% |
| Other | 0.00% | 0.00% | 0.00% | 22.00% |

Although the process of this invention has been described in detail with reference to a preferred embodiment, it can be appreciated that there are other embodiments of the process of this invention within the scope and spirit of the claims.

I claim:

1. A process for producing liquid helium comprising:

(a) providing a feed vapor comprising at least 20 percent helium at a temperature of 150° K. or less;

(b) cooling and partially condensing the feed to produce helium vapor and liquid remainder;

(c) warming helium vapor by indirect heat exchange with cooling feed of step (b);

(d) upgrading the helium vapor to liquefier grade helium vapor;

(e) passing liquefier grade helium vapor to a helium liquefier;

(f) partially condensing liqueifer grade helium vapor in the helium liquefier to produce liquid helium and helium recycle vapor;

(g) compressing helium recycle vapor;

(h) cooling at least some compressed helium recycle vapor by indirect heat exchange with warming helium vapor of step (c); and (i) returning cooled, compressed helium recycle vapor to the helium liquefier.

2. The process of claim 1 wherein the feed vapor comprises from 30 to 60 percent helium.

3. The process of claim 1 wherein the feed vapor is taken from a nitrogen rejection unit and contains at least about 30 percent nitrogen.

4. The process of claim 1 wherein a helium-containing stream at a temperature exceeding 150° K. is combined with the feed vapor prior to or during step (b).

5. The process of claim 1 wherein the warmed helium vapor of step (c) is combined with air and the combined stream heated and passed over a catalyst bed wherein hydrogen which may be present is oxidized to water.

6. The process of claim 5 wherein the output from the catalyst bed is passed to a pressure swing adsorption process to produce liquefier grade helium vapor which is passed to the helium liquefier as the liquefier grade helium vapor of step (e), and tail gas.

7. The process of claim 6 wherein tail gas is reintroduced to feed vapor prior to or during step (b).

8. The process of claim 1 wherein the partial condensation of the liquefier grade helium vapor of step (f) is carried out by work expansion.

9. The process of claim 8 wherein the work expansion produces vapor having at least two different pressure levels.

10. The process of claim 1 wherein some of the compressed helium recycle vapor is returned directly to the helium liquefier without undergoing cooling of step (h).

11. The process of claim 1 wherein liquid remainder is partially vaporized and the vapor is reintroduced to the feed vapor prior to or during step (b).

12. The process of claim 11 wherein the liquid remainder from the said partial vaporization is itself partially vaporized and at least some of the vapor is recovered.

13. The process of claim 12 wherein the recovered vapor comprises primarily nitrogen.

14. The process of claim 12 wherein some of said vapor is liquefied and recovered as liquid.

15. The process of claim 14 wherein said liquid comprises primarily nitrogen.

16. The process of claim 1 wherein the ratio of the flowrate of the compressed helium recycle vapor which undergoes the cooling of step (h) to the flowrate of the feed vapor is in the range of from 0.8 to 1.2.

17. The process of claim 1 wherein the upgrading of the helium vapor to liquefier grade helium vapor is by pressure swing adsorption.

* * * * *

UNITED STATES PATENT AND TRADEMARK OFFICE

CERTIFICATE OF CORRECTION

PATENT NO. : 4,666,481

DATED : May 19, 1987

INVENTOR(S) : R.R. Olson, Jr.

It is certified that error appears in the above-identified patent and that said Letters Patent is hereby corrected as shown below:

In column 2, line 33 delete "NUR" and insert therefor --NRU--.

In claim 1, line 12 delete "liqueifer" and insert therefor --liquefier--.

Signed and Sealed this

First Day of September, 1987

*Attest:*

*Attesting Officer*

DONALD J. QUIGG

*Commissioner of Patents and Trademarks*